United States Patent [19]

Bille

[11] 4,444,120

[45] Apr. 24, 1984

[54] TRACK-BOUND ELECTRIC MOTOR VEHICLE

[75] Inventor: Günter Bille, Berlin, Fed. Rep. of Germany

[73] Assignee: Siemens Aktiengesellschaft, Munich, Fed. Rep. of Germany

[21] Appl. No.: 274,442

[22] Filed: Jun. 17, 1981

[30] Foreign Application Priority Data

Jul. 1, 1980 [DE] Fed. Rep. of Germany ..... 3025278

[51] Int. Cl.[3] ..... B61C 9/44

[52] U.S. Cl. ..... 105/131; 105/117; 105/136; 295/36 R

[58] Field of Search ..... 105/133, 136, 137, 182 E, 105/130, 135, 117, 131; 180/54 C, 65 E, 6.48, DIG. 1; 295/36 R, 39; 301/124 R, 126, 132

[56] References Cited

U.S. PATENT DOCUMENTS

| | | | |
|---|---|---|---|
| 35,083 | 4/1862 | Cooper | 295/39 |
| 1,505,261 | 8/1924 | Heistand | 295/39 |
| 2,501,307 | 3/1950 | Binney | 105/136 |

FOREIGN PATENT DOCUMENTS

| | | | |
|---|---|---|---|
| 5777 | 12/1979 | European Pat. Off. | 105/136 |
| 624995 | 2/1936 | Fed. Rep. of Germany | 105/133 |
| 1947045 | 3/1971 | Fed. Rep. of Germany | 105/182 E |
| 2258645 | 6/1974 | Fed. Rep. of Germany | 105/136 |

*Primary Examiner*—Randolph Reese

*Attorney, Agent, or Firm*—Kenyon & Kenyon

[57] ABSTRACT

Disclosed is a driving arrangement for an electric motor vehicle in which each of the two wheels of an axle is supported on separate shaft sections. Each motor or each rotor of a dual rotor motor drives only one driving wheel of an axle in order to mechanically decouple the driving wheels. One of the separate shaft sections of the axles includes a tapered portion which forms a shaft stub and the other shaft section includes a hollow shaft stub. The tapered shaft stub is supported in the hollow shaft stub by a slide bearing disposed inside the hollow shaft stub. Speed differences at the slide bearing between the axle sections can result only from slippage when negotiating a turn or from uneven wear of, for example, the wheels.

10 Claims, 3 Drawing Figures

TRACK-BOUND ELECTRIC MOTOR VEHICLE

BACKGROUND OF THE INVENTION

The present invention relates to a track-bound electric motor vehicle and improved driving means therefor.

European Patent Application Publication No. 0 005 777 discloses a track-bound electric motor vehicle having electric traction motors which drive respective driving wheels of the vehicle via gears and in which both driving wheels of an axle are fastened to separate shaft sections guided relative to each other and forming a driving axle.

The two driving wheels of an axle of the electric motor vehicle are each driven seperately by an electric traction motor. Each driving wheel is fastened on a hollow shaft and the two hollow shafts are supported on a common rigid stationary shaft. Thereby, mechanical decoupling of the two driving wheels is achieved and the slippage of one of the wheels otherwise occuring in negotiating curves is avoided.

In the vehicle of the aforementioned European patent application, the full speed of rotation of the driving wheels is always present at the support of the hollow shafts on the rigid shaft, which makes use of grease- or oil-lubricated bearings, particularly anti-friction bearings, necessary. Therefore, the outside diameter of the hollow shaft must be made relatively large. Furthermore, no spring or cushioning apparatus is provided for the hollow shaft with the large gear or for the traction motors, which can result in a degrading of the running performance of the vehicle.

OBJECTS AND SUMMARY OF THE INVENTION

It is an object of the present invention to improve the mechanical decoupling of the driving wheels of an axle or of adjacent axles in a track-bound electric motor vehicle.

It is another object of the present invention to provide a mechanical decoupling for driving wheels in a track-bound vehicle which requires less space and little maintenance.

These and other objects are achieved according to the invention, by providing separate shaft sections to form a two shaft axle with one of the shaft sections having a shaft stub and the other of the shaft sections having a hollow shaft stub which receives and supports the shaft stub. The two seperate shaft sections are placed inside each other and form the driving axle.

In accordance with an embodiment of the invention, the shaft stub of the one shaft section is provided tapered or with a reduced dimension and the hollow shaft stub is sized to receive the tapered stub.

Bearing means in accordance with the invention are provided in the hollow stub between the inner surface of the hollow stub and the outer surface of the tapered stub. In accordance with an embodiment of the invention, the bearing means comprise a slide bearing. At the bearing means between the two shaft sections, e.g. between the tapered shaft stub and the hollow shaft stub, only small speed differentials can occur, namely, only those which correspond to slippage occuring when negotiating curves or those resulting from uneven wear in the two shaft sections. In accordance with the invention, the load on the slide bearings is very light and the bearings can accordingly be compact, taking up little space and requiring little maintenance.

In an embodiment of the invention, the slide bearing between the shaft stub and the hollow shaft stub can be dry-lubricated thereby obviating bearing-related maintenance of any kind.

According to one aspect of the invention, the masses of the driving axle can be sprung, i.e. elastically supported with respect to the wheels. In one embodiment, a hollow shaft surrounds each separate shaft section with clearance. One of the hollow shafts receives a reduced dimension portion of the other of the hollow shafts. An elastic coupling is connected to each separate shaft section for supporting and also centering the hollow shafts, and for coupling them to the separate shaft sections.

The gearing can comprise in accordance with embodiments of the invention a gear fastened to each separate shaft section or to each hollow gear section by means of which motor means can be coupled to the shaft sections.

The motor means can comprise in accordance with an embodiment of the invention a double-rotor motor with the gearing coupling each rotor to a respective shaft section directly or via a respective hollow shaft and an elastic coupling. The motor means can be supported on the shaft sections by a nose suspension bearing.

A driving axle, mechanically decoupled in accordance with the invention as described above, can also be employed for dual axle drives as well as for single axle drives.

In a two axle drive, the two axles are parallel and longitudinally spaced apart. In accordance with an embodiment of the invention, motor means comprising two dual rotor motors can be interposed between the two axles, each of the motors being coupled directly to a shaft section or to a shaft section via a hollow shaft and an elastic coupling. Both rotors can advantageously be disposed in a common stator and each rotor can include two rotor sections, one of which includes a reduced dimension portion and the other of which includes a hollow portion which receives and supports the reduced dimension portion.

These and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
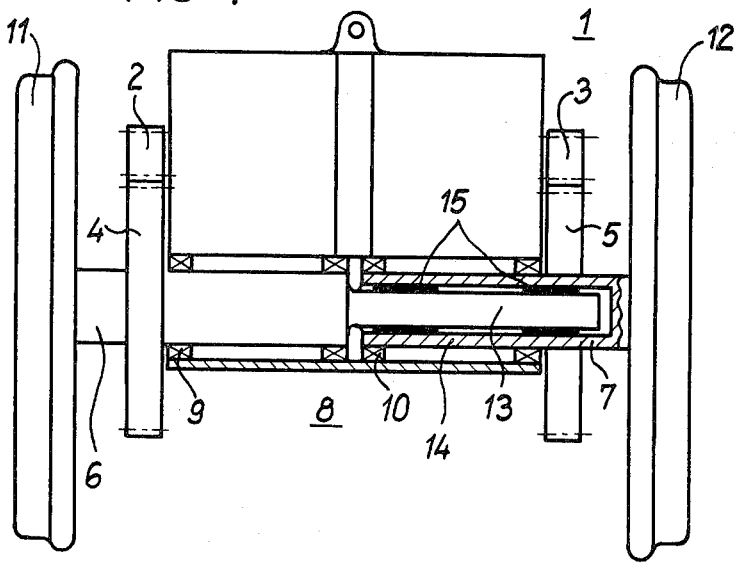
FIG. 1 is a vertical cross section view taken through part of the driving axle of a single-axle drive according to the invention.

FIG. 1 depicts a single-axle transversal drive of a track-bound electric motor vehicle in which the electric traction motor 1 is a dual-rotor motor having the two rotors supported independently of each other (not shown). The two rotors are disposed inside a common stator and are therefore subject to common excitation, each rotor driving a different pinion 2, 3 of a coupling arrangement. Each pinion 2, 3 drives, a shaft section 6, 7, respectively, of the driving axle 8 via a larger gear 4, 5 connected to the respective shaft section. The traction motor 1 is supported on both shaft sections 6, 7 by means of nose-suspension bearings 9 and 10.

A driving wheel 11, 12 is fastened to each shaft section 6, 7, respectively, of the driving axle 8. The shaft section 6 includes at its end facing the shaft section 7, a tapered or reduced diameter shaft stub 13 which extends into the interior of a hollow shaft stub 14. Two dry-lubricated slide bearings 15 support and center the shaft stub 13 in the hollow shaft stub 14. Only slippage generated during travel of the vehicle through a curve or caused by uneven wear in the shaft sections, e.g. in the driving wheels 11 and 12, is present at the slide bearings 15. Accordingly, the load on the slide bearings 15 is light.

Mechanical decoupling of the two driving wheels 11 and 12 of the driving axle 8 according to the invention reduces noise produced in the operation of the motor vehicle and allows the interval between servicing, e.g. for equalizing the driving wheel diameters, to be increased.

Figure 2:
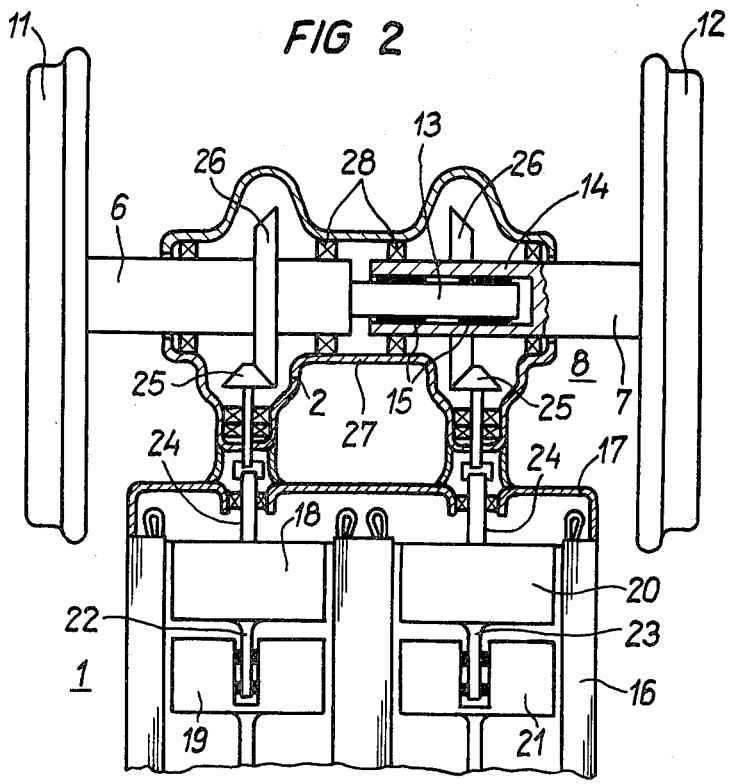
FIG. 2 is a longitudinal section view taken through part of one of the axles of a two axle drive according to the invention.

Referring now to FIG. 2, a mechanically decoupled driving axle of the type described above is depicted for a two-axle drive. The two axles of the two-axle drive are parallel to each other and spaced apart, only one of the axles being shown in FIG. 2. The two axles are mechanically decoupled, with each axle being driven by rotors of different dual rotor motors. The dual rotor motors are disposed in a common stator 16 having a common end bell 17. Such an arrangement reduces weight and permits the lamination stacks to be produced in a common cut. Rotors 18, 20 each include a reduced diameter stub 22, 23, respectively, and rotors 19, 21 each include a hollow portion. Rotors 18, 19, and rotors 20, 21 of each dual-rotor motor are supported in each other via the stubs 23, 24, and the hollow portions. This arrangement provides mechanical decoupling for the adjacent shaft section 6 and 7 of each axle as well as for adjacent axles.

The rotor shaft 24 of each dual-rotor motor drives a respective shaft section via a miter gear arrangement. The rotor shaft of each motor drive is coupled to a pinion gear 25 which meshes with a larger gear 26 connected to a respective shaft section 6, 7. The gear box housing 27, common for each driving axle 8, is supported on the two shaft sections 6 and 7 by anti-friction bearings 28.

The motor of FIG. 2 provides opposite directions of rotation for the rotors 18 and 20 of the adjacent dual-rotor motors. A motor can also be used which provides for the same direction of rotation of the adjacent dual-rotor motors. In that case, the larger gear 26 is mounted turned 180 degrees from the position shown in FIG. 2 and two identical gear boxes could be used instead of the common gear box 27.

It is to be understood that mechanically decoupled driving arrangements in accordance with the invention, as described above for example, can be used for other longitudinal drive configurations utilizing dual-rotor motors.

Figure 3:
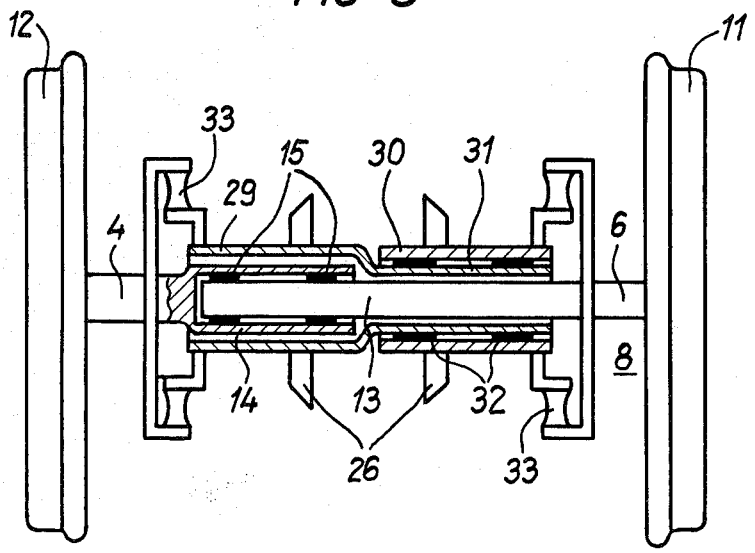
FIG. 3 is a vertical section view taken through part of a driving axle of a drive according to another embodiment of the invention suitable for mounting in the undercarriage of a track-bound motor vehicle.

In the embodiments of FIGS. 1 and 2, the driven masses of the electric motor vehicle can only be sprung to a limited extent by providing appropriate rubber elements in the driving wheels themselves. In accordance with the invention, the electric traction motor can be fastened in the undercarriage, for example, a two-axle longitudinal drive in a floating arrangement in order to spring the driven masses. Such an arrangement is depicted in FIG. 3. The larger gears 26 are not supported on the shaft sections 6, 7 of the driving axle 8 itself, but on respective hollow shafts 29, 30 which surround the driving axle 8 with a clearance. Hollow shaft 29 has a smaller diameter extension 31 which extends into the interior of hollow shaft 30 and is supported therein by bearings 32. The bearings 32 are designed as dry-lubricated maintenance-free slide bearings since the relative speed of rotation between the two hollow shafts 29 and 30 is small. In addition, each hollow shaft 29, 30 is connected to the corresponding shaft section 6, 7 by a centering elastic coupling 33. The coupling 33 can be a rubber ring spring coupling as well as other elastic couplers, such as linkage couplings. The couplings 33 provide primary cushioning of the mass of the hollow shafts 29, 30 and the drive parts (not shown) against the driving axle 8 and the driving wheels 11 and 12.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. In a track-bound motor vehicle including an axle having two wheels, electric motor means for driving each wheel and gearing for coupling the electric motor means to the wheels, the improvement comprising an axle having a separate shaft section coupled to each wheel, one of the shaft sections including a reduced dimension portion and the other of the shaft sections having a hollow portion which receives the reduced dimension portion of the one shaft section, bearing means for supporting the reduced dimension portion of the one shaft section in the hollow portion of the other shaft section, a hollow shaft surrounding each separate shaft section with clearance, one of the hollow shafts having a reduced dimension portion which is received in and supports the other of the hollow shafts, and an elastic coupling connected to each separate shaft section for elastically supporting the hollow shafts and coupling them to the separate shaft sections.

2. The improvement according to claim 1, wherein the gearing includes a gear fastened to each separate shaft section.

3. The improvement according to claim 1 and including means for elastically supporting parts of the axle relative to the wheels.

4. The improvement, according to claim 1, wherein the gearing includes a gear connected to each hollow shaft.

5. The improvement according to claim 2, 1, or 4 wherein the electric motor means comprises a double-rotor motor having a rotor coupled to a respective shaft section.

6. The improvement according to claim 5 and comprising nose suspension bearings for supporting the motor on the two shaft sections.

7. The improvement according to claim 1 or 4 for use in a two-axle drive in which the two axles are parallel and longitudinally spaced apart, wherein the motor means comprises two dual rotor motors interposed between the two axles, each of the motors being coupled to a shaft section of each of the two driving axles.

8. The improvement according to claim 7, wherein dual rotors of both motors are disposed in a common stator.

9. The improvement according to claim 7, wherein each dual rotor includes two rotor sections, one rotor section having a reduced dimension portion and the other rotor section having a hollow portion, the reduced dimension rotor portion being received and supported in the hollow portion of the other rotor section.

10. The improvement according to claim 1, wherein the bearing means between the reduced dimension shaft portion and the hollow shaft portion is a dry-lubricated slide bearing.

* * * * *